US006392368B1

(12) United States Patent
Deller et al.

(10) Patent No.: US 6,392,368 B1
(45) Date of Patent: May 21, 2002

(54) DISTRIBUTED LIGHTING CONTROL SYSTEM

(75) Inventors: Robert W. Deller, Santa Clarita; Robert C. Heagey, Acton, both of CA (US)

(73) Assignee: Home Touch Lighting Systems LLC, Salt Lake City, UT (US)

( * ) Notice: Subject to any disclaimer, the term of this patent is extended or adjusted under 35 U.S.C. 154(b) by 0 days.

(21) Appl. No.: 09/697,869

(22) Filed: Oct. 26, 2000

(51) Int. Cl.[7] ..... H05B 37/00

(52) U.S. Cl. ..... 315/317; 315/312; 315/315; 315/360; 315/362

(58) Field of Search ..... 315/312, 315, 315/317, 318, 325, 360, 362; 340/310.01, 538, 825.06, 825.52

(56) References Cited

U.S. PATENT DOCUMENTS 5,420,482 A * 5/1995 Phares ..... 315/292
5,821,704 A * 10/1998 Carson et al. ..... 315/317
5,920,156 A * 7/1999 Carson et al. ..... 315/317
6,229,432 B1 * 5/2001 Fridley et al. ..... 340/310.01

* cited by examiner

*Primary Examiner*—Haissa Philogene
(74) *Attorney, Agent, or Firm*—Fulbright & Jaworski L.L.P.

(57) ABSTRACT

A lighting system includes a plurality of control modules distributed on the AC power line for remote control of lights within a residential/office building structure. Each control module is hard-wired to an electrical load and is provided with a dimmer and up to four control switches and LEDs for status indication. Each control module has a data decoder, a switch and LED interface, a dimmer driver and processor with memory for independently processing and communicating data signals to the other control modules on the AC power line without the need for a central processor to coordinate the lighting control operation. Every control module is programmable through a programmable module and a PC. The system data downloaded to each control module includes a unique address, a system configuration file and a response file for evaluating system transmission commands. Each control switch may be programmed to control the hard-wired load or any other load in the system.

39 Claims, 7 Drawing Sheets

| 26 BIT COMMUNICATION: | |
|---|---|
| BITS | FUNCTION |
| 4 | HOUSE ADDRESS |
| 6 | ACTION |
| 8 | STATION ADDRESS |
| 3 | SWITCH ADDRESS |
| 5 | CHECK SUM |
| 26 | |

| SWITCH TYPES: | |
|---|---|
| 0 | NOT ASSIGNED |
| 1 | MOMENTARY |
| 2 | TOGGLE |
| 3 | TIMED TOGGLE |
| 4 | TIMED FLASH |
| 5 | DIMMER |
| 6 | |
| 7 | |
| 8 | MASTER ON |
| 9 | MASTER OFF |
| 10 | SCENE PRESET |
| 11 | TOGGLE MASTER ON |
| 12 | TOGGLE MASTER OFF |
| 13 | MASTER DIMMER |
| 14 | |
| 15 | |

| LOAD TYPES: | |
|---|---|
| 0 | NOT ASSIGNED |
| 1 | NON-DIM |
| 2 | NON-DIM NOT |
| 3 | DIMMER |
| 4 | |
| 5 | |

| SWITCH ACTIONS: | | |
|---|---|---|
| MISC. | 0 | NOT ASSIGNED |
| | 1 | SWITCH UP |
| | 2 | TIMED ON |
| | 3 | TIMED FLASH |
| | 4 | STOP TIMED FLASH |
| | 5 | |
| | 6 | |
| | 7 | |
| OFF'S: | 8 | OFF |
| | 9 | OFF MASTER |
| | 10 | OFF PRESET |
| | 11 | |
| | 12 | |
| | 13 | |
| | 14 | |
| | 15 | |
| ON'S: | 16 | ON DIM LEVEL |
| | 17 | ON FULL |
| | 18 | ON DIM LEVEL -RAMP |
| | 19 | ON MASTER |
| | 20 | ON PRESET |
| | 21 | STO PRESET (SU - 6SEC) |
| | 22 | ON DIM LEVEL - MRAMP 100% |
| | 23 | ON DIM LEVEL - MRAMP |
| | 24 | ON DIM LEVEL MASTER |
| | 25 | |
| | 26 | |
| | 27 | |
| | 28 | |
| | 29 | |
| | 30 | |
| | 31 | |
| | 32-63 | SYSTEM COMMAND CODES |

FIG. 3

SWITCH ACTIONS

SWITCH TYPES AND ACTION TRANSMISSIONS

| | | ACTION | | | | | | | | | |
|---|---|---|---|---|---|---|---|---|---|---|---|
| | | LED OFF OR YELLOW FLASHING | | | | | | LED ON | | | |
| | | | @ 400MS: | | | | | | | | |
| # | TYPE | SD | SU | SD | SU | SU>0.4 | SD@12 | SD | SU<.4S | SD @ .4 | SU |
| 0 | NOT ASSIGNED | | | | | | | | | | |
| 1 | MOMENTARY | 16 | | | 8 | | | 16 | | | 8 |
| 2 | TOGGLE | 16 | | | | | | 8 | | | |
| 3 | TIMED TOGGLE | 2 | | | | | | 8 | | | |
| 4 | TIMED FLASH | 3/4* | | | | | | 8 | | | |
| 5 | DIMMER | 16 | | 18 | | 1 | | | 8 | 18 | |
| 6 | | | | | | | | | | | |
| 7 | | | | | | | | | | | |
| 8 | MASTER ON | 19 | | | | | | 19 | | | |
| 9 | MASTER OFF | 9 | | | | | | 9 | | | |
| 10 | SCENE PRESET | | | | 20 | | 21 | 10 | | | |
| 11 | TOGGLE MASTER ON | 19 | | | | | | 9 | | | |
| 12 | TOGGLE MASTER OFF | 9 | | | | | | 19 | | | |
| 13 | MASTER DIMMER | 24 | | 22 | | 1 | | | 8 | 23 | |
| 14 | | | | | | | | | | | |
| 15 | | | | | | | | | | | |

* SEND 3 IF LED IS OFF. SEND 4 IF LED IS FLASHING YELLOW

FIG. 4

FIG. 5

Load responses to switch actions:

Load Actions

| Switch Actions: | | | Load Actions: Not Assigned | Non-dim | Non-dim Not | Dimmer |
|---|---|---|---|---|---|---|
| Misc: | 0 | Not Assigned | | | | |
| | 1 | Switch Up | | | | stop ramp - store level |
| | 2 | Timed On | | on - t/on | off - t/on | on to dim level - t/on |
| | 3 | Timed Flash | | flashon - t/flash | flashoff - t/flash | flash on 100% - t/flash |
| | 4 | Stop Timed Flash | | on | off | on 100% |
| | 5 | | | | | |
| | 6 | | | | | |
| | 7 | | | | | |
| Off's: | 8 | Off | | off | on | off |
| | 9 | Master Off | | off | on | off |
| | 10 | Preset Off | | off | on | fade off - t/preset off |
| | 11 | | | | | |
| | 12 | | | | | |
| | 13 | | | | | |
| | 14 | | | | | |
| | 15 | | | | | |
| On's: | 16 | On dim level | | on | off | on to dim level |
| | 17 | Full On | | on | off | on - 100% |
| | 18 | Ramp dimmer | | on | off | begin ramp * |
| | 19 | On Master | | on | off | on to dim level |
| | 20 | On Preset | | on | off | fade to table level - t/preset |
| | 21 | Sto Preset (su - 6sec) | | stay on | stay off | store level - stop ramp |
| | 22 | On dim level - Mramp100 | | on | off | on to dim level - ramp to 100% ** |
| | 23 | On dim level - Mramp | | on | off | on to dim level - ramp like dimmer |
| | 24 | On dim level Master | | on | off | on to dim level if load was off |
| | 25 | | | | | |
| | 26 | | | | | |
| | 27 | | | | | |
| | 28 | | | | | |
| | 29 | | | | | |
| | 30 | | | | | |
| | 31 | | | | | |
| | 32-63 | Reserved for System Commands, see Station <-> Programming Module <-> Host communication sheets | | | | |

* ramp dir after being off is always up, thereafter it alternates direction

** first cycle after being off is like a preset (all loads converge to 100% in one ramp cycle time) thereafter, all loads are locked together and behave as a single dimmer

FIG. 6

Led responses to switch actions:

LED Actions

| Switch Actions: | | | Switch Types | | | | | | | | | | | | | | | |
|---|---|---|---|---|---|---|---|---|---|---|---|---|---|---|---|---|---|---|
| | | | NA (0) | Mom(1) | Tog (2) | TTog(3) | FTog(4) | Dim(5) | Spare(6) | Spare(7) | MOn(8) | MOff(9) | SP(10) | TMOn(11) | TMOff(12) | MDim(13) | Spare(14) | Spare(15) |
| Misc: | 0 | Not Assigned | 0 | 0 | 0 | 0 | 0 | 0 | 0 | 0 | 0 | 0 | 0 | 0 | 0 | 0 | 0 | 0 |
| | 1 | Switch Up | 0 | 0 | 0 | 0 | 0 | 0 | 0 | 0 | 0 | 0 | 0 | 0 | 0 | 0 | 0 | 0 |
| | 2 | Timed On | 0 | 1 | 3 | 3 | 1 | 3 | 0 | 0 | 1 | 1 | 1 | 1 | 0 | 1 | 0 | 0 |
| | 3 | Timed Flash | 0 | 1 | 4 | 1 | 4 | 4 | 0 | 0 | 1 | 1 | 1 | 1 | 1 | 1 | 0 | 0 |
| | 4 | Stop Timed Flash | 0 | 0 | 6 | 0 | 6 | 6 | 0 | 0 | 0 | 0 | 0 | 0 | 0 | 0 | 0 | 0 |
| | 5 | | 0 | 0 | 0 | 0 | 0 | 0 | 0 | 0 | 0 | 0 | 0 | 0 | 0 | 0 | 0 | 0 |
| | 6 | | 0 | 0 | 0 | 0 | 0 | 0 | 0 | 0 | 0 | 0 | 0 | 0 | 0 | 0 | 0 | 0 |
| | 7 | | 0 | 0 | 0 | 0 | 0 | 0 | 0 | 0 | 0 | 0 | 0 | 0 | 0 | 0 | 0 | 0 |
| Off's: | 8 | Off | 0 | 1 | 1 | 1 | 1 | 1 | 0 | 0 | 1 | 0 | 1 | 1 | 0 | 1 | 0 | 0 |
| | 9 | Off Master 1 | 0 | 1 | 1 | 1 | 1 | 1 | 0 | 0 | 1 | 5 | 1 | 1 | 5 | 1 | 0 | 0 |
| | 10 | Off Preset 1 | 0 | 1 | 1 | 1 | 1 | 1 | 0 | 0 | 1 | 0 | 1 | 1 | 0 | 1 | 0 | 0 |
| | 11 | | 0 | 0 | 0 | 0 | 0 | 0 | 0 | 0 | 0 | 0 | 0 | 0 | 0 | 0 | 0 | 0 |
| | 12 | | 0 | 0 | 0 | 0 | 0 | 0 | 0 | 0 | 0 | 0 | 0 | 0 | 0 | 0 | 0 | 0 |
| | 13 | | 0 | 0 | 0 | 0 | 0 | 0 | 0 | 0 | 0 | 0 | 0 | 0 | 0 | 0 | 0 | 0 |
| | 14 | | 0 | 0 | 0 | 0 | 0 | 0 | 0 | 0 | 0 | 0 | 0 | 0 | 0 | 0 | 0 | 0 |
| | 15 | | 0 | 0 | 0 | 0 | 0 | 0 | 0 | 0 | 0 | 0 | 0 | 0 | 0 | 0 | 0 | 0 |
| On's: | 16 | On dim level | 0 | 5 | 2 | 1 | 1 | 2 | 0 | 0 | 1 | 1 | 1 | 1 | 1 | 5 | 0 | 0 |
| | 17 | On Full | 0 | 5 | 2 | 1 | 1 | 2 | 0 | 0 | 0 | 1 | 1 | 1 | 1 | 1 | 0 | 0 |
| | 18 | On dim level - ramp | 0 | 1 | 2 | 1 | 1 | 2 | 0 | 0 | 1 | 1 | 1 | 1 | 1 | 1 | 0 | 0 |
| | 19 | On Master | 0 | 1 | 2 | 1 | 1 | 2 | 0 | 0 | 5 | 1 | 1 | 5 | 1 | 1 | 0 | 0 |
| | 20 | On Preset | 0 | 1 | 2 | 1 | 1 | 2 | 0 | 0 | 1 | 1 | 5 | 1 | 1 | 1 | 0 | 0 |
| | 21 | Sto Preset (su - 6sec) | 0 | 1 | 2 | 1 | 1 | 2 | 0 | 0 | 1 | 1 | 5 | 1 | 1 | 1 | 0 | 0 |
| | 22 | On dim level - Mramp100 | 0 | 1 | 2 | 1 | 1 | 2 | 0 | 0 | 1 | 1 | 1 | 1 | 1 | 5 | 0 | 0 |
| | 23 | On dim level - Mramp | 0 | 1 | 2 | 1 | 1 | 2 | 0 | 0 | 1 | 1 | 1 | 1 | 1 | 5 | 0 | 0 |
| | 24 | On dim level master | 0 | 1 | 2 | 1 | 1 | 2 | 0 | 0 | 1 | 1 | 1 | 1 | 1 | 5 | 0 | 0 |
| | 25 | | 0 | 0 | 0 | 0 | 0 | 0 | 0 | 0 | 0 | 0 | 0 | 0 | 0 | 0 | 0 | 0 |
| | 26 | | 0 | 0 | 0 | 0 | 0 | 0 | 0 | 0 | 0 | 0 | 0 | 0 | 0 | 0 | 0 | 0 |
| | 27 | | 0 | 0 | 0 | 0 | 0 | 0 | 0 | 0 | 0 | 0 | 0 | 0 | 0 | 0 | 0 | 0 |
| | 28 | | 0 | 0 | 0 | 0 | 0 | 0 | 0 | 0 | 0 | 0 | 0 | 0 | 0 | 0 | 0 | 0 |
| | 29 | | 0 | 0 | 0 | 0 | 0 | 0 | 0 | 0 | 0 | 0 | 0 | 0 | 0 | 0 | 0 | 0 |
| | 30 | | 0 | 0 | 0 | 0 | 0 | 0 | 0 | 0 | 0 | 0 | 0 | 0 | 0 | 0 | 0 | 0 |
| | 31 | | 0 | 0 | 0 | 0 | 0 | 0 | 0 | 0 | 0 | 0 | 0 | 0 | 0 | 0 | 0 | 0 |

| Codes: | | |
|---|---|---|
| | 0 | No Action |
| | 1 | Off |
| | 2 | On Green |
| | 3 | Timed Yellow |
| | 4 | Flash Yellow |
| | 5 | Preset Green |
| | 6 | On Yellow |

Notes: Code 3: Yellow for the programed "on" time, off when complete.
Code 4: Yellow and flashing for the programed "on" time. Stays on when complete.
Code 5: Green LED on if it's the transmitting switch, otherwise off.

Response file data is transferred in five parts, one byte at a time from left to right then top to bottom. Each part is to be sent with a 12 bit checksum.
Part One contains the following Variable Tables (112 bytes)
Parts 2 thru 5 contain the response table broken into 4 blocks of 256 bytes each (64 station address per block, 4 switches per station).

| Preset Table: | |
|---|---|
| 0 | 0 |
| level 0 | time 0 |
| level 1 | time 1 |
| level 2 | time 2 |
| level 3 | time 3 |
| level 4 | time 4 |
| level 5 | time 5 |
| level 6 | time 6 |
| level 7 | time 7 |
| level 8 | time 8 |
| level 9 | time 9 |
| level 10 | time 10 |
| level 11 | time 11 |
| level 12 | time 12 |
| level 13 | time 13 |
| level 14 | time 14 |

64 bytes

Each of the 32 table entries are two byte words

The maximum level is 0
The minimum level is 44000

The value for the time is 30 x Fade Time

| Word Table: |
|---|
| DimmerTicks |
| TimerTicks |
| FlashTicks |
| MasterTicks |
| PresetDefaultLevel |
| Min dim level |
| Max dim level |
| Min on level |
| spare |
| spare |
| spare |
| spare |
| spare |
| spare |
| spare |
| spare |

32 bytes

Each of the 16 entries is a two byte word
DimmerTicks = Int( 1425 / dimmer fade time in seconds )
TimerTicks = 30 x On time in seconds
FlashTicks = 30 x Flash time in seconds
MasterTicks = Int( 1425 / dimmer fade time in seconds )
Preset Default Level ( a level between 0 and 45000)
Min dim level (45000 nominal)
Max dim level (0 nominal)
Min on level (45000 nominal) - minimum ramp start level

| Switch Type Table: |
|---|
| switchtype 1 |
| switchtype 2 |
| switchtype 3 |
| switchtype 4 |
| spare |
| spare |
| spare |
| spare |

8 bytes

Each of the 8 entries are one byte

| | |
|---|---|
| 0 - Not Assigned | 8 - Master On |
| 1 - Momentary | 9 - Master Off |
| 2 - Toggle | 10 - Scene Preset |
| 3 - Timed Toggle | 11 - Toggle Master On |
| 4 - Timed Flash | 12 - Toggle Master Off |
| 5 - Dimmer | 13 - Master Dimmer |
| 6 - spare | 14 - spare |
| 7 - spare | 15 - spare |

| Byte Table: |
|---|
| SysFlags |
| spare |
| spare |
| spare |
| spare |
| spare |
| spare |
| spare |

8 bytes

Each of the 8 entries are one byte
msb-dim/nondim, toggle preset, full master, master dim mem, x, x, x, lsb-x dim/nondim; 1-dimmer, 0-nondim
toggle preset; 1-toggle preset, 0-scene preset does not toggle to off
full master; 1-master to full on, 0-master to dim memory
master dim mem: 1 = master dim level, 0 = Dimmer level

| Response Table: | |
|---|---|
| rsp address 0 | start of block 1 |
| rsp address 1 | |
| --- | |
| --- | |
| rsp address 254 | |
| rsp address 255 | end of block 1 |
| | |
| rsp address 256 | start of block 2 |
| rsp address 257 | |
| --- | |
| --- | |
| rsp address 510 | |
| rsp address 511 | end of block 2 |
| | |
| rsp address 512 | start of block 3 |
| rsp address 513 | |
| --- | |
| --- | |
| rsp address 766 | |
| rsp address 767 | end of block 3 |
| | |
| rsp address 768 | start of block 4 |
| rsp address 769 | |
| --- | |
| --- | |
| rsp address 1022 | |
| rsp address 1023 | end of block 4 |

1024 bytes total

Each of the 1024 entries are one byte:
Each of the 1024 entries is an address of a switch in the system, arranged by station number, 4 switches to a station.

| Byte | Description |
|---|---|
| out tab msb | the four bit nibble is |
| out tab 2 | the pointer into the |
| out tab 1 | preset table. See |
| out tab lsb | compiling below: |
| led 4 | act if 1, don't if 0 |
| led 3 | act if 1, don't if 0 |
| led 2 | act if 1, don't if 0 |
| led 1 | act if 1, don't if 0 |

FIG. 7

DISTRIBUTED LIGHTING CONTROL SYSTEM

BACKGROUND OF THE INVENTION

1. Field of the Invention

The present invention relates generally to lighting systems and more particularly to a distributed modular lighting control system for communicating lighting control data over the power lines.

2. Prior Art

In recent years, lighting control systems have become increasingly popular despite their usually prohibitive cost. A conventional lighting control system allows the user to remotely control a network of lighting units from a central location in a housing/office building setting. A lighting system of this type may comprise a plurality of control stations dispersed throughout the site and electrically coupled to a plurality of control modules and a programmable central control unit (CCU) which includes a central processor, holds all programming information in memory and translates button presses from control stations throughout the home into appropriate changes in lighting. The CCU is a fairly expensive component and may be provided with a modem to allow for remote system maintenance or changes to the lighting control system. The control stations are wall-mounted keypads which replace traditional light switches and dimmer controls. For example, a button on a control station may function as both a toggle and a dimmer switch and may have memory for memorizing the dimming level last used. Control modules perform the actual switching and dimming of electrical loads including dimming incandescent, low voltage, fluorescent loads, etc.

Installation of a conventional lighting control system typically requires considerable rewiring and expenditure of time and material. Data communication is typically over the power lines using various data transmission protocols. System reliability remains an issue for the conventional lighting control system even though a number of system and communication improvements have been introduced in the field over the years. For example, during data transmission, the identities of the CCU and the control modules may be confused whereby system reliability is significantly compromised.

After the lighting control system has been installed, the installer must configure and test all system components before use which is normally a relatively complicated, time-consuming and costly procedure.

Furthermore, a typical lighting control system operating over the power line may not offer a choice of carrier frequencies and/or transmitting power levels to the user. A choice of carrier frequencies is usually the first line of defense against unexpected sources of noise on the line. The user should also be able to adjust transmitting power levels depending on the line impedance of the home/office building involved.

Therefore, the need arises for an improved lighting control system for communicating lighting control data over the power line which does not use a central processor to oversee and control the operation. Such a system should preferably be implemented using a distributed system architecture, i.e. every control module having all the system programming information and processing power required to perform its function independently from the other components of the system. A distributed lighting control system of this type would substantially improve the overall system reliability, lower the system cost and provide ease of installation and maintenance for the user. Furthermore, each control module should be capable of operating on a number of carrier frequencies and transmitting power levels to be set by the user.

SUMMARY OF THE INVENTION

The present invention meets the above needs and is directed to a lighting system comprising a plurality of control modules distributed on an alternating current (AC) power line for remote control of electrical loads within a structure, each control module coupled to at least one of the electrical loads, each control module capable of independently processing and communicating data signals to the other control modules on the AC power line for control of one or a group of the electrical loads without the need for a central processor to coordinate the lighting control operation.

At least one of the plurality of control modules comprises a processor, a data decoder coupled to the processor through a data bus and means for driving a dimmer. The dimmer driving means includes a dimmer driver for generating a duty control signal for driving the dimmer through an optoisolator, the dimmer electrically coupled to the AC power line.

The lighting system further comprises means for driving the dimmer driver which includes a bridge rectifier electrically coupled to the AC power line for generating a rectified voltage signal, a potential divider coupled to the bridge rectifier for receiving the rectified voltage signal and means for generating a pulse signal for input to the dimmer driver. The pulse signal generating means includes a comparator operatively coupled to the potential divider and a resistor operatively coupled between the output of the comparator and the dimmer driver.

The lighting system further comprises means for programming at least one of the plurality of control modules. The programming means includes a programming module operatively coupled between the at least one control module and a computer for downloading system configuration data to the at least one control module through the programming module. The lighting system further comprises means for evaluating a data transmission command. The data transmission command evaluating means includes a response table downloaded to the at least one control module from the computer through the programming module for use by the processor, the response table containing an address entry for the at least one control module and a load address entry.

At least one of the plurality of control modules further comprises an application-specific integrated circuit (ASIC) coupled to the processor by way of the data bus. The ASIC includes a field-programmable gate array (FPGA), the FPGA including the dimmer driver and the data decoder.

The present invention is also directed to a lighting system comprising a plurality of control modules distributed on an alternating current (AC) power line within a structure, each control module having at least one control switch and at least one light-emitting diode (LED) operatively coupled to the at lest one control switch for status indication, each control module capable of independently processing and communicating data signals to the other control modules on the AC power line without the need for a central processor to coordinate the lighting control operation.

At least one of the plurality of control modules comprises a processor, a data decoder coupled to the processor through a data bus and a switch and LED interface operatively coupled between the at least one control switch and the at least one LED.

The lighting system further comprises means for programming at least one of the plurality of control modules. The programming means includes a programming module operatively coupled between the at least one control module and a computer for downloading system configuration data to the at least one control module through the programming module.

The lighting system further comprises means for evaluating a data transmission command. The data transmission command evaluating means includes a response table downloaded to the at least one control module from the computer through the programming module for use by the processor, the response table containing an address entry for the at least one control module, for the at least one control switch and for the at least one LED.

At least one of the plurality of control modules further comprises an application-specific integrated circuit (ASIC) coupled to the processor by way of the data bus. The ASIC includes a field-programmable gate array (FPGA), the FPGA including the switch and LED interface and the data decoder.

The present invention is further directed to a lighting system comprising a plurality of control modules distributed on an alternating current (AC) power line for remote control of electrical loads within a structure, each control module coupled to at least one of the electrical loads and having at least one control switch and at least one light-emitting diode (LED) operatively coupled to the at lest one control switch for status indication, each control module capable of independently processing and communicating data signals to the other control modules on the AC power line for control of one or a group of the electrical loads without the need for a central processor to coordinate the lighting control operation.

At least one of the plurality of control modules comprises a processor, a data decoder coupled to the processor through a data bus, a switch and LED interface operatively coupled between the at least one control switch and the at least one LED and means for driving a dimmer. The dimmer driving means includes a dimmer driver for generating a duty control signal for driving the dimmer through an optoisolator, the dimmer electrically coupled to the AC power line.

The lighting system further comprises means for driving the dimmer driver which includes a bridge rectifier electrically coupled to the AC power line for generating a rectified voltage signal, a potential divider coupled to the bridge rectifier for receiving the rectified voltage signal and means for generating a pulse signal for input to the dimmer driver. The pulse signal generating means includes a comparator operatively coupled to the potential divider and a resistor operatively coupled between the output of the comparator and the dimmer driver.

The lighting system further comprises means for programming at least one of the plurality of control modules. The programming means includes a programming module operatively coupled between the at least one control module and a computer for downloading system configuration data to the at least one control module through the programming module.

The lighting system further comprises means for evaluating a data transmission command. The data transmission command evaluating means includes a response table downloaded to the at least one control module from the computer through the programming module for use by the processor, the response table containing an address entry for the at least one control module, for the at least one control switch, for the at least one LED and a load address entry.

At least one of the plurality of control modules further comprises an application-specific integrated circuit (ASIC) coupled to the processor by way of the data bus. The ASIC includes a field-programmable gate array (FPGA), the FPGA including the dimmer driver, the data decoder and the switch and LED interface.

The present invention is still further directed to a control module for use in a lighting system distributed on an alternating current (AC) power line within a structure, the control module comprising a processor; a data decoder coupled to the processor through a data bus; a switch and light-emitting diode (LED) interface operatively coupled to the data decoder; and a dimmer driver, the control module electrically coupled to the structure wiring and capable of independently receiving and transmitting communication signals within the distributed lighting system.

In accordance with one aspect of the invention, the control module further comprises means for programming the control module. The programming means includes a programming module operatively coupled between the control module and a computer for downloading system configuration data to the control module through the programming module. The control module further comprises means for evaluating a data transmission command. The data transmission command evaluating means includes a response table downloaded to the control module from the computer through the programming module for use by the processor, the response table containing an address entry for the control module.

In accordance with another aspect of the present invention, the control module further comprises an application-specific integrated circuit (ASIC) coupled to the processor by way of the data bus. The ASIC includes a field-programmable gate array (FPGA), the FPGA including the switch and LED interface, the dimmer driver and the data decoder.

These and other aspects of the present invention will become apparent from a review of the accompanying drawings and the following detailed description of the preferred embodiments of the present invention.

BRIEF DESCRIPTION OF THE DRAWINGS

FIG. 3 is a tabular representation of a preferred embodiment of the present invention;

FIG. 4 is a tabular representation of another preferred embodiment of the present invention;

FIG. 5 is a tabular representation of still another preferred embodiment of the present invention;

FIG. 6 is a tabular representation of yet another preferred embodiment of the present invention; and FIG. 7 shows a response file/table format for use in accordance with the present invention.

DETAILED DESCRIPTION OF THE PREFERRED EMBODIMENTS

Figure 1:
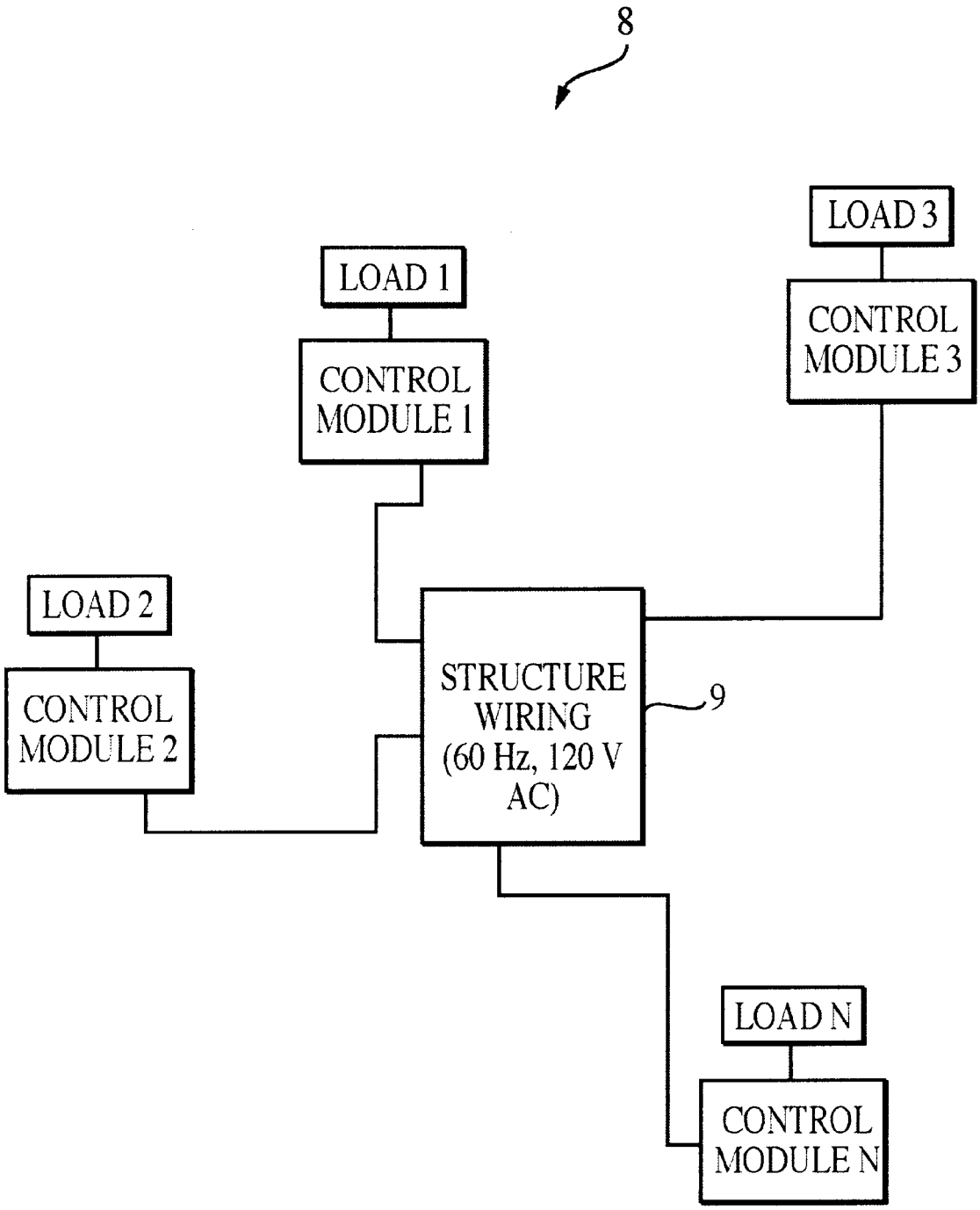
FIG. 1 is a block diagram of a distributed lighting system in accordance with the present invention.

Hereinafter, some preferred embodiments of the present invention will be described in detail with reference to the related drawings of FIGS. 1–7. Additional embodiments, features and/or advantages of the invention will become apparent from the ensuing description or may be learned by the practice of the invention.

In the figures, the drawings are not to scale and reference numerals indicate the various features of the invention, like numerals referring to like features throughout both the drawings and the description.

The following description includes the best mode presently contemplated for carrying out the invention. This description is not to be taken in a limiting sense, but is made merely for the purpose of describing the general principles of the invention.

The present invention is directed to a distributed lighting system 8 (FIG. 1) used for communicating lighting control data over the power line in a house/office building setting or the like. Lighting system 8 of the present invention represents an integration of hardware, embedded firmware and programming software designed to allow effective transmission and receiving of high frequency data signals over the 60 Hz power line for remote control of electrical loads such as for dimming incandescent, low voltage, fluorescent, electronic ballasted fluorescent, neon and cold cathode loads and the like. Lighting system 8 comprises a plurality of control modules, e.g. control module 1, control module 2, control module 3 . . . control module N (where N could be as high as 250—see FIG. 1) distributed on the secondary of a two-phase power distribution transformer (see, e.g., structure wiring 9, FIG. 1) at various locations within a structure such as a house, commercial office building or the like. Each control module is connected to an electrical load (see, e.g., load 1, load 2, load 3 . . . load N in FIG. 1) and communicates with the other control modules to control one load or a group of loads over the AC power line. This type of setup allows the system to be easily retrofitted in an existing dwelling with minimal or no additional re-wiring.

Figure 2:
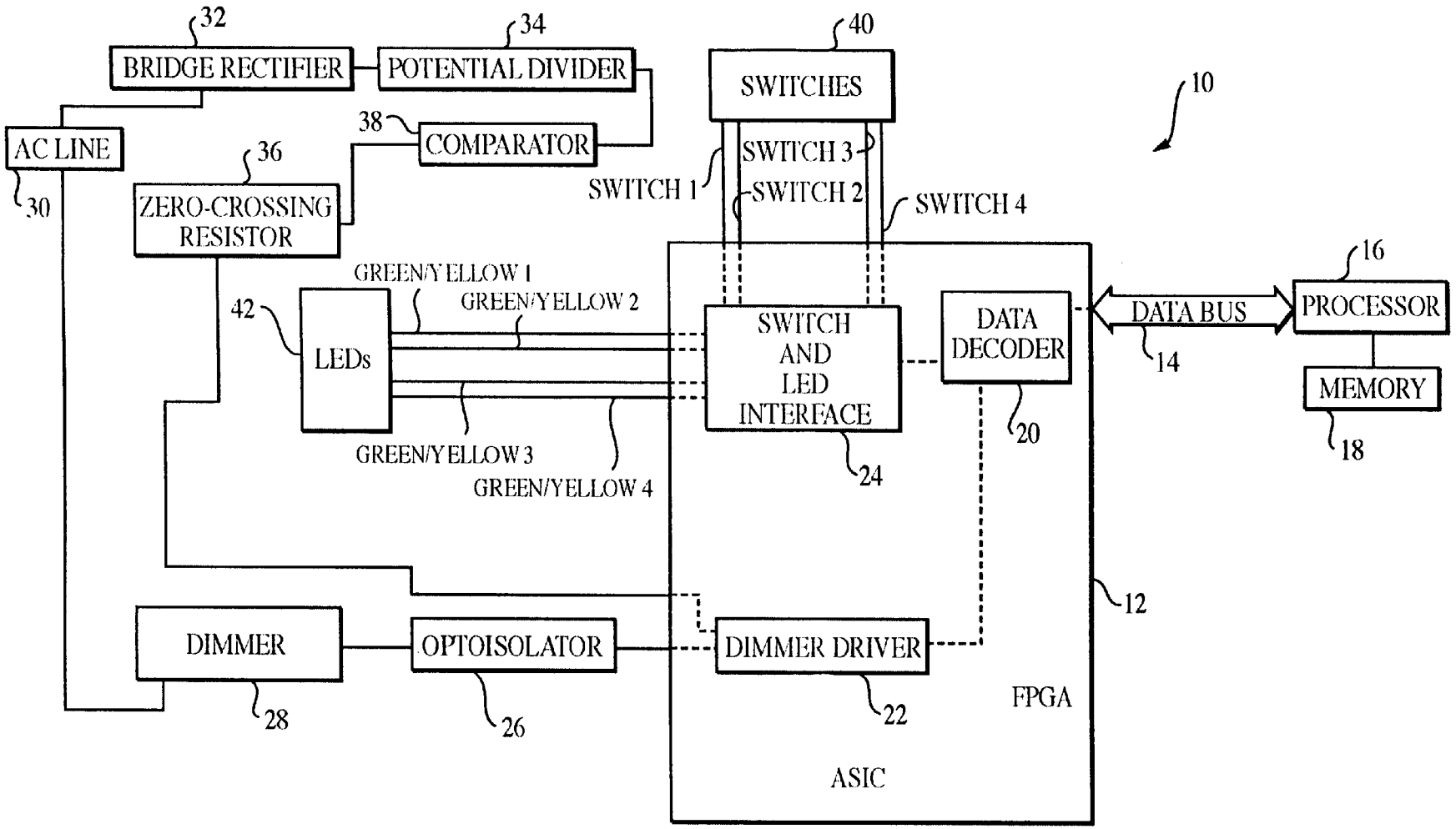
FIG. 2 is a block diagram of a control module for use in a distributed lighting system in accordance with the present invention.

A typical control module for use in accordance with the present invention, generally referred to by reference numeral 10, is shown in FIG. 2 and comprises an application-specific integrated circuit (ASIC) 12 including a field programmable gate array (FPGA) electrically coupled to a relatively inexpensive processor 16 provided with a memory 18 via a 2-bit wide data bus 14. A field programmable gate array and processor suitable for practicing the present invention may be purchased, for example, from Xilinx, Inc. of San Jose, Calif., and from Philips Signetics of Eindhoven, The Netherlands, respectively.

As further shown in FIG. 2, ASIC 12 comprises a data decoder 20 operatively coupled between processor 16 (via data bus 14), a digital dimmer driver 22 and a switch and LED interface 24. Switch and LED interface 24 is coupled between control switches 40 and light-emitting diodes (LEDs) 42 which are provided for status indication. Control module 10 includes four control switches (Switches 1–4) and LEDs 42 include green/yellow LED 1, green/yellow LED 2, green/yellow LED 3 and green/yellow LED 4. All switches and load control elements function independently and the basic control module types being wall box dimmer, wall box relay, ceiling dimmer, ceiling relay and plug-in dimmer. Using a host software, any switch in the system maybe programmed to control any load or any group of loads in one of several modes which include toggle, momentary, dimmer, timed on, flashing on, scene preset, master on, master off, master dimmer and master toggle off. Other module types and/or operational modes may be utilized, provided there is no departure from the intended purpose of the present invention.

Dimmer driver 22 generates a duty control signal which drives a conventional triac dimmer 28 via a standard optoisolator 26. Optoisolator 26 includes a gallium-arsenide infrared-emitting diode optically coupled to a silicon phototriac mounted on an electrically insulated 6-terminal (pin) lead frame and may be purchased from Texas Instruments, Inc. of Dallas, Tex. A bridge rectifier 32 draws power from AC line 30 and produces a full-wave rectified d.c. output voltage signal across its positive and negative terminals (not shown) which is passed through a potential divider 34. The voltage output from potential divider 34 is passed through a conventional comparator 38 which preferably has a slight negative bias so that the line voltage goes through a zero crossing with the negative bias pulling the non-inverting pin (not shown) of comparator 38 below ground. A zero-crossing resistor 36 is coupled between comparator 38 and dimmer driver 22 of ASIC 12 so that at every zero voltage crossing of the line a pulse is generated. The pulse re-synchronizes a digital counter (not shown) in dimmer driver 22 which when it times out will set the dimmer driver output to optoisolator 26 low firing the triac. Processor 16 signals ASIC 12 as to what dimmer level is required by selecting an appropriate address in ASIC 12 and then sending a 2-byte word into a buffer (not shown) which pre-loads the digital counter to count down.

In accordance with a preferred embodiment of the present invention, the inventive lighting control system does not include a central processor to oversee and coordinate system operation. Instead, the inventive lighting control system is implemented using distributed architecture, i.e. every control module (or node) contains all the information and processing power (see, for example, processor 16 in FIG. 2) required to perform its role independently within the system. A person skilled in the art would readily recognize that a distributed control system of this type significantly improves system reliability, installation and maintenance thereby lowering the overall cost of the system.

Installation of the inventive lighting control system by an electrician comprises a number of steps. For example, one of the steps involves the electrician recording the serial number, location of each control module and the type of load controlled by each control module during installation for future use. Each control module is hard-wired to a specific load for control purposes. Another step is testing the loads by pressing one of the switches (e.g. the top button-dimmer control) on each module (station) whereby each station has not been programmed yet and behaves as a stand-alone unit. No communication is possible at this point between the control modules. Thereafter, a programming module (not shown) is plugged into the system and connected to a computer (PC) via an RS 232 port. The programming module has the same basic structure as control module 10 (FIG. 2) with regards to power line communication hardware and software but it has not dimmer and no switches, rather an RS 232 interface to the programming software located in the PC. The function of the programming module is simply to bridge the communication from the PC to the distributed control modules. The installer (or user) then loads the host software onto the PC. The host software is used to program the system in three steps.

The first step is represented by a table to identify all system components—there is a row entry for every control module installed, a column entry for every module serial number, a column entry for a descriptive name of each module, a column entry for the load that each module is controlling and a column entry for the number of switches on each station (module).

The second step is represented by a switch assignment table which has an index for every switch and station on the system. A load is then assigned to each switch. It is worth noting in this regard that since a module is hard-wired to a specific load, each switch on the module may be programmed to control that load or any other loads in the system. There is thus no association in the hardware between switches and loads controlled. Furthermore, as shown in FIG. 2, the dimmer object in the control module has no system attachment to the switches except that the top switch button is usually shipped pre-programmed as a dimmer for testing purposes. A database of all load assignments is thus created to indicate how every load is supposed to behave depending on the particular switch being pressed.

The third step in the host programming set up involves downloading data to the control modules via the programming module. For example, the carrier frequency (e.g., 115 kHz or 131 kHz) may be chosen and the transmit power level may be chosen by the user. Specifically, the transmit power level is set on a per module basis for optimal flexibility. The actual download is done in three stages. The first stage includes assigning a unique station number and house number to each module corresponding to a pre-recorded (by the electrician) module serial number. The second stage includes sending to each control module address (via the programming module and the power line) its configuration file which includes what type of switch is Switch 1, Switch 2, etc. and the maximum/minimum dimmer level, dimmer fade rate. The third stage is downloading a response file (or table) to each control module which provides information on switches and corresponding loads which each station needs to know to be able to respond to a communication transmission from another module. Thus, every control module (station) receives an address, a configuration file and a response file. Handshaking is required to make sure that all stations are properly configured. Once the first station has acknowledged receiving all system data, the host software proceeds to configure all of the remaining stations one by one until all system information is downloaded. At that point, the PC may be turned off and the programming module may be unplugged from the system as the system may now operate on its own. If the system needs to reconfigured at a later time, the PC and the programming module are to be used in the manner described hereinabove.

In accordance with another preferred embodiment of the present invention, every switch press may initiate from one to three transmissions that are broadcast to and received by all other control modules via AC power line 30. Since all control modules must listen to the broadcast, handshaking or otherwise acknowledging receipt of the transmission is not used. To improve the likelihood that a transmission would be successfully broadcast to all of the other modules, each transmission is repeated once as part of an error detection scheme which includes a bit error count. A bit error count is the number of errors between the two transmission copies that are allowed before the entire transmission is scrapped. Lower numbers make it less likely for errant transmissions to get through, however that increases the possibility for missed communications. This parameter is preferably set on a per module basis for optimal flexibility. Further details on data signal communication via the power line and the error detection scheme may be found in United States Patent Application entitled "Date Communication Over Power Lines", filed concurrently with the instant patent application, both patent applications having identical inventors and being assigned to common assignee, the contents of which is incorporated herein by reference.

Specifically, when a switch is pressed by the user, the control module processes the switch command and generates a system-wide transmission which preferably includes a house code (1 of 16 house codes which uniquely identify to which lighting control system the control module belongs), a control module number (to identify which one of the 250 possible control modules is transmitting), a switch number (which can be 1 of 4 switches, FIG. 2) and the type of action desired. Each of the other control modules within the system receives the transmission and performs a series of checks. The first check is to determine if the received house code is applicable, i.e. part of the system within which the transmission was generated. If the transmitted house code is not part of the system, the transmission is discarded and the module maintains its current state. If the transmitted house code is part of the system, each of the receiving control modules then checks the transmitted module and switch numbers against a response table (FIG. 7—response table data format) to determine whether the control module objects (LEDs and load) should evaluate the received transmission for possible state changes. The response table is a table of bytes (1 byte=8 bits) which is about 1000 bytes long. A byte entry exists in the table for every module and switch number in the system. Specifically, a receiving module would take the transmitted module (or station) number, multiply the same by 4 and then add the transmitted number to it to create a 1/1000 index (unique number) for identifying the transmitting station and switch in the response table. The last four bits are used as flags to tell the receiving module whether each of the four possible LEDs has any connection with the commanding switch. If there is no connection, the value for the flag would be "0" and no action is taken for that LED. If a connection exists, the value will be "1" and the processor (e.g., processor 16 in FIG. 1) will evaluate the command action and set the LED based upon the LED/switch type and the commanded action.

Similarly, the load object uses the first 4 bits of the table byte to determine its response. Specifically, the processor in the receiving module examines the first 4 bits of the table byte to check if the value is "0" or not. If the value is "0", the receiving module disregards the transmission and generates no response. If the value is non-zero, an association exists between the switch button pressed and the load that the receiving module (or station) is controlling and therefore a corresponding response must be generated to change the load state.

Most actions may be evaluated with no further information other than the first 4 bits having a non-zero value, however, in case of so-called "scene preset" command actions, the first 4 bits of the table byte is a pointer into a separate scene preset table which contains the commanded preset dimmer level and fade time. A "scene preset" is a function that the user can assign to a switch to perform on a load or on a group of loads to create a particular lighting scene. The reverse is also possible, i.e. a load can respond to a switch or to any number of switches. An example of a scene preset table (Table 1) follows hereinbelow.

TABLE 1

Scene Preset Table

| scene preset # | level | time | action |
|---|---|---|---|
| 0 | | | no action |
| 1 | 1452 | 300 | dimmer |
| 2 | 403 | 300 | preset 1 |
| 3 | 787 | 1800 | preset 2 |
| 4 | — | — | preset 3 |
| 5 | — | — | preset 4 |
| 6 | — | — | preset 5 |
| 7 | | | preset 6 |
| 8 | — | — | preset 7 |
| 9 | — | — | preset 8 |
| 10 | — | — | preset 9 |
| 11 | — | — | preset 10 |
| 12 | — | — | preset 11 |
| 13 | — | — | preset 12 |
| 14 | — | — | preset 13 |
| 15 | — | — | preset 14 |

The host software compiles the programming data into the above-described response table by finding every switch object that affects the load on the module whose table is being generated. The first 4 bits of the table byte will be made non-zero for every switch address that affects the load. For every controlling switch that is a scene preset, the host software will increment the first 4 bits to define the specific location in the scene preset table. Thus, a maximum of 15 scene presets may be assigned to a single load. Also, LED flags are set at each switch address in which the specific switch location in the table and LED/switch for which the table belongs, controls the same load within the system.

A person skilled in the art would appreciate that generation of the response table is a relatively straight forward task since the structure of the system allows all LEDs and load state decisions to be uniquely made given only the command action and information regarding the object's association with the commanding switch. This type of structure automatically keeps the LED and load states in synchronization with each other on every command. Obviously, prior art systems that transmit switch actions (e.g., switch up, switch down) and remember the last state within the object (LEDs, switches and loads) itself will get out of synchronization very easily if a single communication is missed.

FIG. 3 illustrates an example in tabular form of the basic switch types, load types and switch actions that may be practiced in the present invention. Furthermore, a 26-bit communication set up is shown. More details on the 26-bit communication set up may be found in the above-described concurrently filed patent application.

A detailed view of all possible switch actions is provided in tabular form in FIG. 4. As shown in the table, the actual transmitted action (command) depends on the type of switch that has been assigned. The command also depends on the switch press timing and current state of the switch as indicated by the LED states. What follows is a brief description of switch press timing schemes:

1. LED is off or flashing yellow
   - switch down (sd)—the code shown in the table is transmitted immediately a switch press.
   - switch still down at 400 ms after initial switch press—the code shown in the table is transmitted.
   - switch up (su)—transmission occurs when the switch is released.
   - switch up after 400 ms after initial switch press—transmission is sent.
   - switch down at 12 s—indicated action code will be sent.
2. LED is on
   - switch down (sd)—the code shown in the table is transmitted immediately a switch press.
   - switch up before 400 ms—transmission is sent.
   - switch still down at 400 ms after initial switch press—the code shown in the table is transmitted.
   - switch up (su)—transmission occurs when the switch is released.
   - switch down at 12 s—indicated action code will be sent.

The associated load actions are shown in detail (in tabular form) in FIG. 5. Generally, load actions are a function of the command action and type of load (e.g., dimmer of non-dimmer load) that is being controlled.

FIG. 6 illustrates in detail all possible LED actions as a function of command action and switch type associated with the LED that is being controlled (e.g., momentary, dimmer, scene preset).

The above-mentioned switch action, load action and LED action tables are preferably hard-wired into each control module, i.e. the tables reside in the module firmware. Furthermore, every control module "listens" and responds to the same command at the same time which ensures a smooth and efficient system operation.

In accordance with yet another preferred embodiment of the present invention, a data bus timing scheme is employed to minimize collisions of data and when big packets of data are being sent over AC line 30 quiet times are provided. For example, station to station and global programming module to station transmission are shown in Table 2 hereinbelow:

TABLE 2

| | | |
|---|---|---|
| transmitting station | T1 | T2 |
| all other stations | | |

Programming module to specific station transmission (requires response) is shown in Table 3 hereinbelow:

TABLE 3

| | | | | |
|---|---|---|---|---|
| programming module | T1 | T2 | | |
| responding station | | | R2 | R2 |
| all other stations | | | Quiet | Quiet |

If a station misses one of the transmissions, it will distort the two quiet periods. This setup still guarantees at least one quiet communication for the responding station to communicate back to the programming module.

Programming module data download to station (requires response) is shown in Table 4 hereinbelow:

TABLE 4

| | | | | | | | | | | | | |
|---|---|---|---|---|---|---|---|---|---|---|---|---|
| programming modules | T1 | T2 | | | D1 | D2 | | | D3 | D4 | | |
| responding station | | | Quiet | Quiet | Listen | Listen | Quiet | Quiet | Listen | Listen | | |
| all other stations | | | | | Quiet | Quiet | | | Quiet | Quiet | | |
| programming modules | | | | — | — | | | Dn-1 | Dn | | | |
| responding station | Quiet | Quiet | | Listen | Listen | Quiet | Quiet | Listen | Listen | R1 | R2 | |
| all other stations | | | | Quiet | Quiet | | | Quiet | Quiet | | | |

The quiet periods for "all other stations" assures that the critical download data will be able to get through to the responding station. The quiet times for the programming module and the responding station leave clean opportunities for regular system operation. This is of particular importance when more than one house is on the same distribution transformer.

The novel control module may be used as a wall station, a ceiling module or a wall module. The distributed lighting control system may also include an interface bridge (not shown) for interconnecting the lighting system to other systems such as smoke detectors, security systems and the like. The interface bridge may include a number of programmable inputs, a number of dry contact relay outputs and an RS 232 port for connecting to a PC or other lighting or AV (audio video) systems.

It should be appreciated by a person skilled in the art that other components and/or configurations may be utilized in the above-described embodiments, provided that such components and/or configurations do not depart from the intended purpose and scope of the present invention.

While the present invention has been described in detail with regards to the preferred embodiments, it should be appreciated that various modifications and variations may be made in the present invention without departing from the scope or spirit of the invention. For example, other switch actions could be specialized for controlling HVAC (heating and air conditioning) or AV systems. Other load actions could operate interlocking relays for controlling motors used for curtains or screens. Also, data such as temperatures or lighting levels could be encoded into the transmissions. In this regard it is important to note that practicing the invention is not limited to the applications described hereinabove. Many other applications and/or alterations may be utilized provided that they do not depart from the intended purpose of the present invention.

It should be appreciated by a person skilled in the art that features illustrated or described as part of one embodiment can be used in another embodiment to provide yet another embodiment such that the features are not limited to the specific embodiments described above. Thus, it is intended that the present invention cover such modifications, embodiments and variations as long as they come within the scope of the appended claims and their equivalents.

What is claimed is:

1. A lighting system comprising a plurality of control modules distributed on an alternating current (AC) power line for remote control of electrical loads within a structure, at least one of said plurality of control modules comprises a processor, a data decoder coupled to said processor through a data bus and means for driving a dimmer, each control module coupled to at least one of said electrical loads, each control module capable of independently processing and communicating data signals to the other control modules on said AC power line for control of one or a group of said electrical loads without the need for a central processor to coordinate the lighting control operation.

2. The lighting system of claim 1, wherein said dimmer driving means includes a dimmer driver for generating a duty control signal for driving said dimmer through an optoisolator, said dimmer electrically coupled to said AC power line.

3. The lighting system of claim 2, further comprising means for driving said dimmer driver.

4. The lighting system of claim 3, wherein said dimmer driver driving means includes a bridge rectifier electrically coupled to said AC power line for generating a rectified voltage signal, a potential divider coupled to said bridge rectifier for receiving said rectified voltage signal and means for generating a pulse signal for input to said dimmer driver.

5. The lighting system of claim 4, wherein said pulse signal generating means includes a comparator operatively coupled to said potential divider and a resistor operatively coupled between the output of said comparator and said dimmer driver.

6. The lighting system of claim 1, further comprising means for programming at least one of said plurality of control modules.

7. The lighting system of claim 6, wherein said programming means includes a programming module operatively coupled between said at least one control module and a computer for downloading system configuration data to said at least one control module through said programming module.

8. The lighting system of claim 7, further comprising means for evaluating a data transmission command.

9. The lighting system of claim 8, wherein said data transmission command evaluating means includes a response table downloaded to said at least one control module from said computer through said programming module for use by said processor, said response table containing an address entry for said at least one control module and a load address entry.

10. The lighting system of claim 2, wherein at least one of said plurality of control modules further comprises an application-specific integrated circuit (ASIC) coupled to said processor by way of said data bus.

11. The lighting system of claim 10 wherein said ASIC includes a field-programmable gate array (FPGA), said FPGA including said dimmer driver and said data decoder.

12. A lighting system comprising a plurality of control modules distributed on an alternating current (AC) power line within a structure, at least of said plurality of control modules comprises a processor, a data decoder coupled to said processor through a data bus and a switch and LED interface operatively coupled between said at least one control switch and said at least one LED, each control module having at least one control switch and at least one light-emitting diode (LED) operatively coupled to said at lest one control switch for status indication, each control module capable of independently processing and communicating data signals to the other control modules on said AC power line without the need for a central processor to coordinate the lighting control operation.

13. The lighting system of claim 12, further comprising means for programming at least one of said plurality of control modules.

14. The lighting system of claim 13, wherein said programming means includes a programming module operatively coupled between said at least one control module and a computer for downloading system configuration data to said at least one control module through said programming module.

15. The lighting system of claim 14, further comprising means for evaluating a data transmission command.

16. The lighting system of claim 15, wherein said data transmission command evaluating means includes a response table downloaded to said at least one control module from said computer through said programming module for use by said processor, said response table containing an address entry for said at least one control module, for said at least one control switch and for said at least one LED.

17. The lighting system of claim 12, wherein at least one of said plurality of control modules further comprises an application-specific integrated circuit (ASIC) coupled to said processor by way of said data bus.

18. The lighting system of claim 17, wherein said ASIC includes a field-programmable gate array (FPGA), said FPGA including said switch and LED interface and said data decoder.

19. A lighting system comprising a plurality of control modules distributed on an alternating current (AC) power line for remote control of electrical loads within a structure, at least of said plurality of control modules comprises a processor, a data decoder coupled to said processor through a data bus, a switch and LED interface operatively coupled between said at least one control switch and said at leasat one LED and means for driving a dimmer, each control module coupled to at least one of said electrical loads and having at least one control switch and at least one light-emitting diode (LED) operatively coupled to said at lest one control switch for status indication, each control module capable of independently processing and communicating data signals to the other control modules on said AC power line for control of one or a group of said electrical loads without the need for a central processor to coordinate the lighting control operation.

20. The lighting system of claim 19, wherein said dimmer driving means includes a dimmer driver for generating a duty control signal for driving said dimmer through an optoisolator, said dimmer electrically coupled to said AC power line.

21. The lighting system of claim 20, further comprising means for driving said dimmer driver.

22. The lighting system of claim 21, wherein said dimmer driver driving means includes a bridge rectifier electrically coupled to said AC power line for generating a rectified voltage signal, a potential divider coupled to said bridge rectifier for receiving said rectified voltage signal and means for generating a pulse signal for input to said dimmer driver.

23. The lighting system of claim 22, wherein said pulse signal generating means includes a comparator operatively coupled to said potential divider and a resistor operatively coupled between the output of said comparator and said dimmer driver.

24. The lighting system of claim 19, further comprising means for programming at least one of said plurality of control modules.

25. The lighting system of claim 24, wherein said programming means includes a programming module operatively coupled between said at least one control module and a computer for downloading system configuration data to said at least one control module through said programming module.

26. The lighting system of claim 25, further comprising means for evaluating a data transmission command.

27. The lighting system of claim 26, wherein said data transmission command evaluating means includes a response table downloaded to said at least one control module from said computer through said programming module for use by said processor, said response table containing an address entry for said at least one control module, for said at least one control switch, for said at least one LED and a load address entry.

28. The lighting system of claim 20, wherein at least one of said plurality of control modules further comprises an application-specific integrated circuit (ASIC) coupled to said processor by way of said data bus.

29. The lighting system of claim 28, wherein said ASIC includes a field-programmable gate array (FPGA), said FPGA including said dimmer driver, said data decoder and said switch and LED interface.

30. A control module for use in a lighting system distributed on an alternating current (AC) power line within a structure, said control module comprising:

(a) a processor;

(b) a data decoder coupled to said processor through a data bus;

(c) a switch and light-emitting diode (LED) interface operatively coupled to said data decoder; and (d) a dimmer driver, said control module electrically coupled to the structure wiring and capable of independently receiving and transmitting communication signals within said distributed lighting system.

31. The control module of claim 30, further comprising means for programming said control module.

32. The control module of claim 31, wherein said programming means includes a programming module operatively coupled between said control module and a computer for downloading system configuration data to said control module through said programming module.

33. The control module of claim 32, further comprising means for evaluating a data transmission command.

34. The control module of claim 33, wherein said data transmission command evaluating means includes a response table downloaded to said control module from said computer through said programming module for use by said processor, said response table containing an address entry for said control module.

35. The control module of claim 30, further comprising an application-specific integrated circuit (ASIC) coupled to said processor by way of said data bus.

36. The control module of claim 35, wherein said ASIC includes a field-programmable gate array (FPGA), said FPGA including said switch and LED interface, said dimmer driver and said data decoder.

37. A lighting system comprising a plurality of control modules distributed on an alternating current (AC) power line for remote control of electrical loads within a structure, each control module coupled to at least one of said electrical loads, each control module including means for independently processing and communicating data signals to the other control modules on said AC power line for control of one or a group of said electrical loads without the need for a central processor to coordinate the lighting control operation.

38. A lighting system comprising a plurality of control modules distributed on an alternating current (AC) power line within a structure, each control module having at least one control switch and at least one light-emitting diode (LED) operatively coupled to said at least one control switch for status indication, each control module including means for independently processing and communicating data signals to the other control modules on said AC power line without the need for a central processor to coordinate the lighting control operation.

39. A lighting system comprising a plurality of control modules distributed on an alternating current (AC) power line for remote control of electrical loads within a structure, each control module coupled to at least one of said electrical loads and having at least one control switch and at least one light-emitting diode (LED) operatively coupled to said at least one control switch for status indication, each control module including means for independently processing and communicating data signals to the other control modules on said AC power line for control of one or a group of said electrical loads without the need for a central processor to coordinate the lighting control operation.

* * * * *